US007878092B1

(12) United States Patent
Eby et al.

(10) Patent No.: US 7,878,092 B1
(45) Date of Patent: Feb. 1, 2011

(54) GRASPING TOOL

(76) Inventors: Benjamin C. Eby, 204 Pleasant St., Soldiers Grove, WI (US) 54655; Eric H. Eby, 33636 Valley La., Lone Rock, WI (US) 53556

( * ) Notice: Subject to any disclaimer, the term of this patent is extended or adjusted under 35 U.S.C. 154(b) by 0 days.

(21) Appl. No.: 12/061,436

(22) Filed: Apr. 2, 2008

Related U.S. Application Data

(60) Provisional application No. 60/909,506, filed on Apr. 2, 2007.

(51) Int. Cl.
*B25B 13/28* (2006.01)

(52) U.S. Cl. ..... 81/112

(58) Field of Classification Search ..... 81/112, 81/113, 114
See application file for complete search history.

(56) References Cited

U.S. PATENT DOCUMENTS

| | | | | | |
|---|---|---|---|---|---|
| 307,186 | A * | 10/1884 | French | 81/112 |
| 337,464 | A * | 3/1886 | Wahler | 7/138 |
| 558,451 | A * | 4/1896 | Ellis | 81/113 |
| 664,226 | A * | 12/1900 | Meyer | 168/45 |
| 968,858 | A * | 8/1910 | Kornberg | 81/62 |
| 1,288,154 | A * | 12/1918 | Palmgren | 279/65 |
| 1,390,738 | A * | 9/1921 | Williams | 81/114 |
| 1,413,444 | A * | 4/1922 | Williams | 81/114 |
| 1,492,466 | A * | 4/1924 | Jarmolowsky | 279/7 |
| 2,216,557 | A * | 10/1940 | McKean | 81/112 |
| 2,669,896 | A * | 2/1954 | Clough | 81/128 |
| 2,701,494 | A * | 2/1955 | Johnson | 81/125 |
| 3,210,836 | A * | 10/1965 | Johanson et al. | 29/278 |
| 3,339,439 | A * | 9/1967 | Van Dalen et al. | 81/112 |
| 3,377,893 | A * | 4/1968 | Shorb | 81/113 |
| 4,235,134 | A * | 11/1980 | McLendon | 81/90.2 |
| 4,608,887 | A * | 9/1986 | Colvin | 81/128 |
| 4,663,999 | A * | 5/1987 | Colvin | 81/128 |
| 5,207,130 | A * | 5/1993 | Payne | 81/90.2 |
| 5,218,890 | A * | 6/1993 | Christ, Jr. | 81/113 |
| 5,337,634 | A * | 8/1994 | Carnesi | 81/128 |
| 5,740,704 | A * | 4/1998 | Payne | 81/60 |
| 6,341,544 | B1 * | 1/2002 | Falzone | 81/128 |
| 7,219,581 | B2 * | 5/2007 | Tulloch et al. | 81/112 |
| 7,246,540 | B2 * | 7/2007 | Rillera | 81/13 |
| 7,311,020 | B2 * | 12/2007 | George | 81/90.2 |
| 2004/0060701 | A1 * | 4/2004 | Harmon et al. | 166/301 |

FOREIGN PATENT DOCUMENTS

| | | | |
|---|---|---|---|
| DE | 3924323 | A1 * | 1/1991 |
| EP | 1382418 | A1 * | 1/2004 |

* cited by examiner

*Primary Examiner*—David B Thomas
(74) *Attorney, Agent, or Firm*—Craig A. Fieschko, Esq.; DeWitt Ross & Stevens S.C.

(57) ABSTRACT

A grasping tool for obtaining a firm grasp on a nut or other fastener structure that may be deformed in size or shape by time and damage. The tool includes a series of elongated fingers arranged radially in a group and mounted for longitudinal movement in a sleeve. A nut or other fastener to be removed is placed between ends of the fingers extending from the sleeve. As the sleeve is moved toward the nut or other fastener the wall of the sleeve pushes the ends of the fingers inward, to grasp firmly the nut or other fastener to be removed. Various structures and methods may be used to move the sleeve over the fingers and to rotate the grasping tool once attached firmly to the nut or other structure to remove the nut or other structure.

23 Claims, 14 Drawing Sheets

GRASPING TOOL

This application claims the benefit of U.S. Provisional Application No. 60/909,506, filed Apr. 2, 2007, which is incorporated herein by reference in its entirety.

FIELD OF THE INVENTION

This invention pertains generally to tools, such as hand operated tools, and, more particularly to such tools used for removing fasteners such as bolts and nuts.

BACKGROUND OF THE INVENTION

It is common for a worker to be faced with a situation where a nut or other securing or fastening device that is to be removed has, over time, or due to exposure to corrosive elements, become rusted or otherwise too tightly affixed to a bolt or an underlying surface. The typical first approach to this situation is to attempt to use a conventional wrench, such as a socket, box, or adjustable wrench, to remove the rusted nut. This approach often fails, as rust or other corrosion that has formed on the nut often distorts the shape and size of the nut, thereby preventing proper seating of a conventional sized wrench on the nut. Furthermore, it is common for nuts exposed to environmental conditions to become corroded and deteriorate such that the edges of the nut become weak. When a conventional wrench is attempted to be used to remove such a nut, the edges of the nut may strip off, thereby preventing any further attempt to remove the nut with a conventional wrench. At this point, after the wrenches have failed to obtain an adequate grip about the nut, the worker may resort to using pliers to remove the nut. This typically results in further stripping of the edges of the nut, as it is very difficult to obtain adequate gripping force on the nut with pliers. Furthermore, access to the nut to be removed may be limited, thereby further preventing the use of pliers.

What is desired, therefore, is a device for removing nuts, bolts, and similar fasteners that may be used to obtain a sufficiently strong grip on a fastener such that a fastener that is fixed in place and distorted in size and shape by time and corrosion may be removed more readily.

SUMMARY OF THE INVENTION

The present invention provides a grasping tool for grasping and removing variously sized nuts and other securing devices. A grasping tool in accordance with the present invention provides substantially uniform pressure on all sides of an object to be removed (such as a nut) such that the applied pressure increases as increased rotational force is applied to the device. The substantially uniform pressure provided by a grasping tool in accordance with the present invention provides a secure grip on a nut sufficient to allow the nut to be removed readily without depending on the integrity of the side ridges of the nut. Thus, a grasping tool in accordance with the present invention facilitates the removal of nuts and similar securing devices which may be rusted, corroded, or otherwise deformed by the elements, or by the use of other tools to remove the securing device.

A grasping tool in accordance with the present invention includes a series of elongated fingers arranged radially in a group and mounted for longitudinal movement in a sleeve. A nut or other fastener to be removed is placed between ends of the fingers extending from the sleeve. As the sleeve is moved toward the nut or other fastener the wall of the sleeve pushes the ends of the fingers inward, to grasp firmly the nut or other fastener to be removed. Various structures and methods may be used to move the sleeve over the fingers and to rotate the grasping tool once attached firmly to the nut or other structure to remove the nut or other structure.

The objects and advantages of the invention will appear more fully from the following detailed description of the preferred embodiment of the invention made in conjunction with the accompanying drawings.

DETAILED DESCRIPTION OF THE INVENTION

Figure 1B:
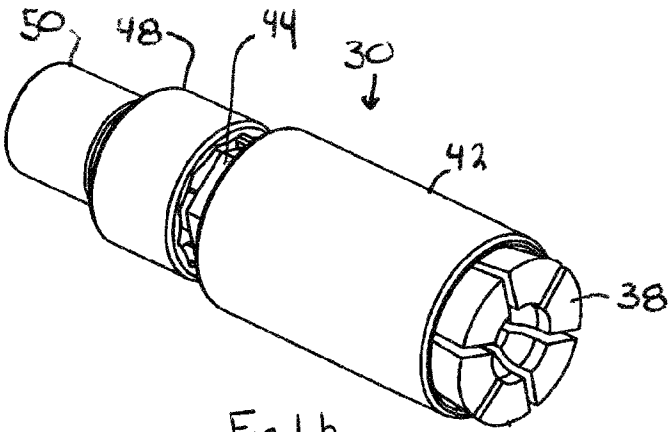
FIG. 1 is a perspective view illustration of an exemplary first embodiment of a grasping tool in accordance with the present invention, showing fingers thereof in an open position and a socket lock thereof in an up position.

The present invention will now be described in detail with reference to the drawing figures, which illustrate various embodiments of the invention. It should be noted that similar elements and structures having the same functionality in the various illustrated embodiments will be referred to in the drawings using the same reference numerals. It should also be noted that all of the components illustrated in the drawing figures are not necessarily presented to scale, but are illustrated in a manner to facilitate illustration and understanding. Finally, dimensions are not provided for any of the components described and illustrated herein. It should be understood that a grasping tool in accordance with the present invention may be made in any convenient size, depending upon the size of the nuts or other fasteners to be removed using the tool. Unless otherwise noted, all of the components of a grasping tool in accordance with the present invention may be made and assembled using conventional manufacturing techniques and of any appropriate material, such as steel.

Figure 2B:
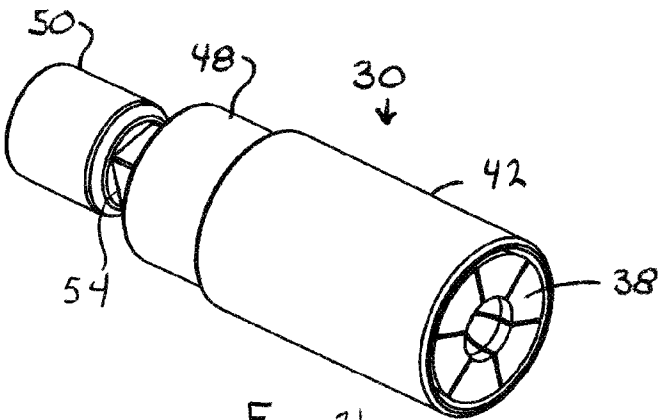
FIG. 2 is a perspective view illustration of the exemplary grasping tool in accordance with the present invention of FIG. 1, showing fingers thereof in a closed position the socket lock in a down position.
Figure 1A:
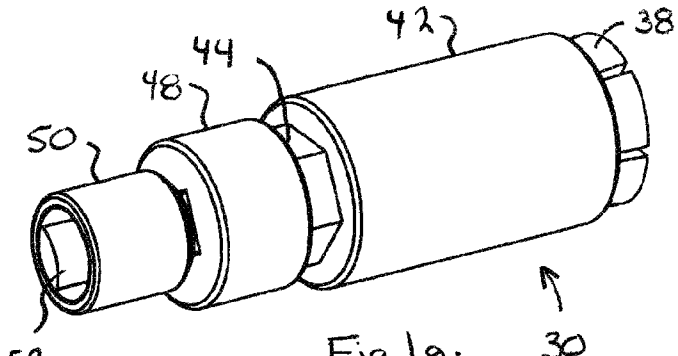
Figure 2A:
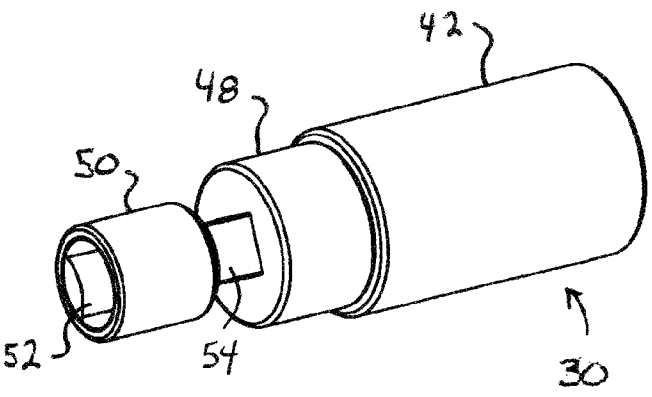
Figure 3:
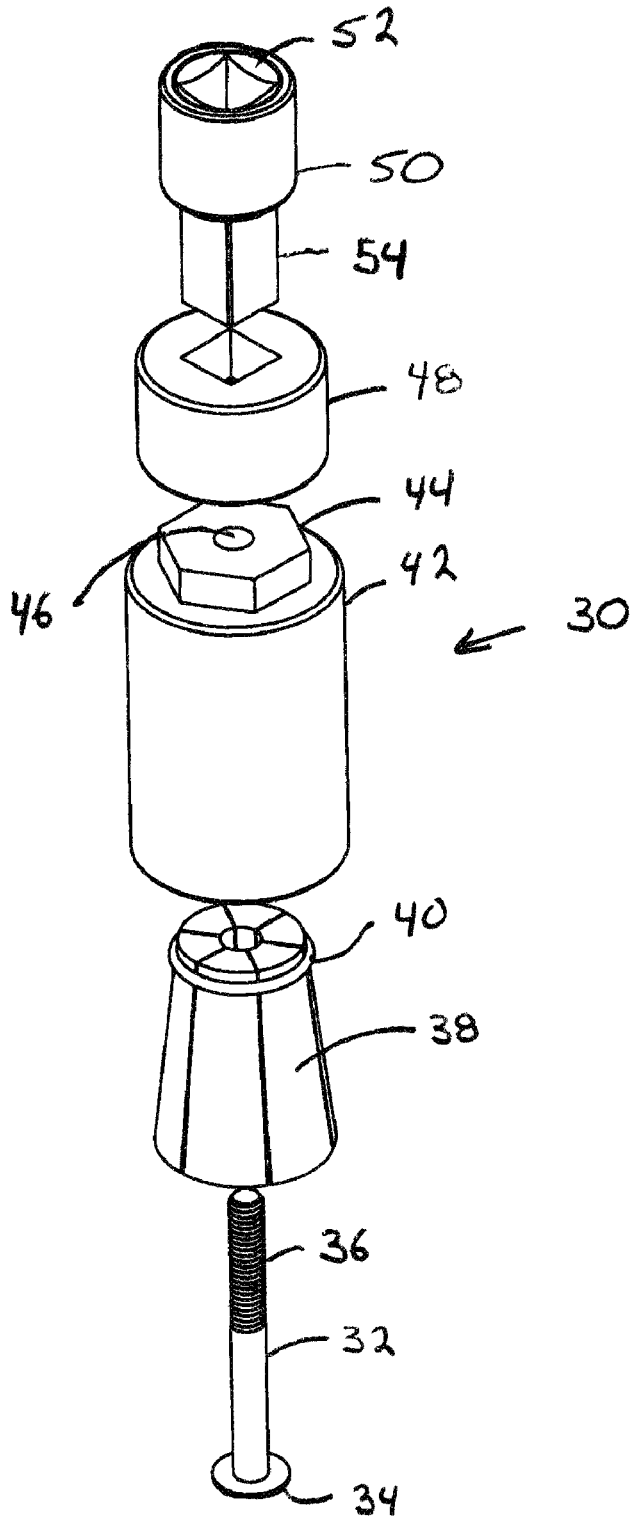
FIG. 3 is an exploded perspective view illustration of the exemplary grasping tool in accordance with the present invention of FIG. 1.
Figure 4:
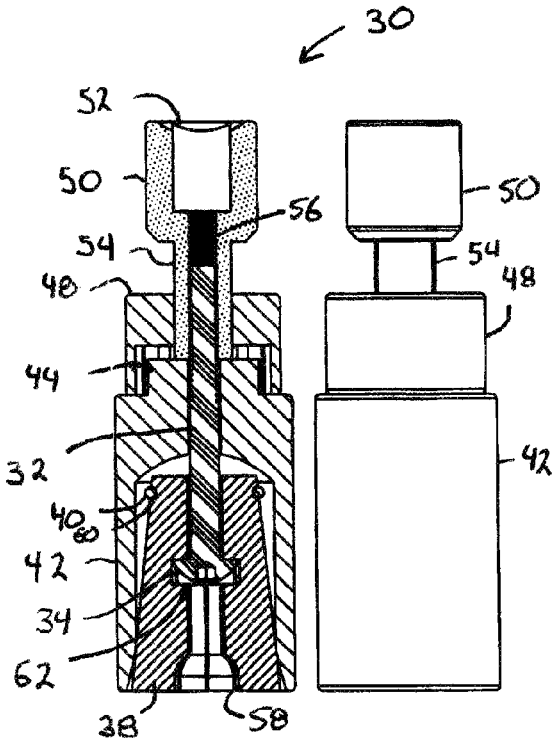
FIG. 4 is a side-by-side cross-section and side view of the exemplary grasping tool in accordance with the present invention of FIG. 1, showing fingers thereof in a closed position and the socket lock in a down position.
Figure 5:
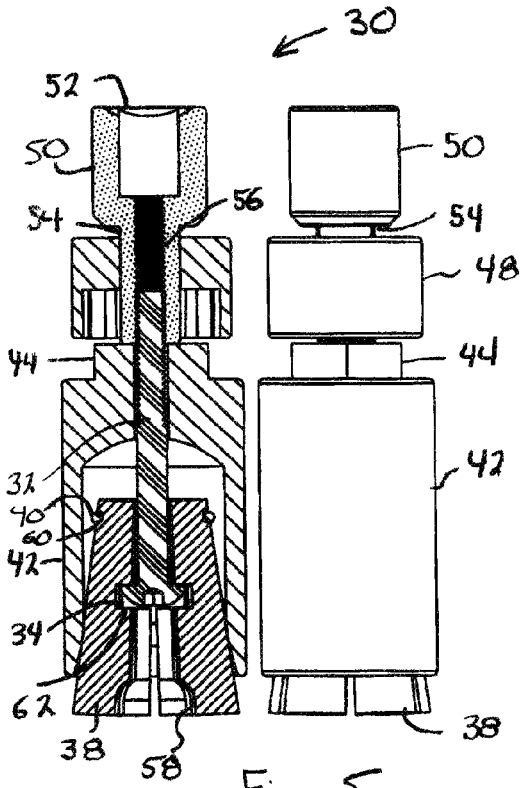
FIG. 5 is a side-by-side cross-section and side view of the exemplary grasping tool in accordance with the present invention of FIG. 1, showing fingers thereof in an open position and the socket lock in an up position.

A first exemplary embodiment of a grasping tool 30 in accordance with the present invention is depicted in FIGS. 1-5. FIGS. 1 and 5 show the grasping tool 30 in an open position, as it would be before engaging a nut. FIGS. 2 and 4 show the grasping tool 30 in a closed position, as it would be after engaging a nut or other fastener type.

Various components of the grasping tool 30 are illustrated in the exploded perspective view of FIG. 3. These components include: a bolt 32 with a head portion 34 and a threaded portion 36; a series of fingers 38 that are bound together by a ring 40 forming a concentric unit; a sleeve 42 with an adjusting nut portion 44 formed on or secured to the top thereof, wherein the sleeve and adjusting nut have a passage 46 therethrough; a socket 48 configured to engage the adjusting nut 44 on top of the sleeve 42 and to receive an end piece 50; and an end piece 50 with a top portion 52 configured to accept a socket driver, and a bottom portion 54 that extends through the center of the socket 48. The end piece 50 further includes a threaded passage 56 for engaging the threaded portion 36 of the bolt 32. The fingers 38 each have an interior indentation 58 at the bottom thereof for extending around and grasping a nut or other fastener structure. The ring 40, which fits into a groove 60 formed near the top on the exterior side of each finger 38, is used to restrain the series of fingers 38 from separating from each other at their top portions. The fingers 38 may be uniform in width along the length thereof, or may be configured such that each finger 38 decreases in width as it approaches its top portion, a wider bottom portion would provide additional rotational torque. Each finger 32 has an indentation 62 on its interior side near the top portion for receiving a portion of the head 34 of the bolt 32.

The fingers 32 are inserted into the sleeve 42 along with the ring 40 and the bolt 32. The bolt head 34 is situated inside the series of fingers 38 and seated against the indentation 62 thereon. The threaded end 36 of the bolt 32 is inserted through the aperture 46 through the sleeve 42 and the adjusting nut 44 atop the sleeve 42, and through the central aperture of the socket 48, and is threaded into the end of the bottom portion 54 of the end piece 50. The bolt head 34 thus engages each of the fingers 38 longitudinally, such that when the bolt 32 is threaded upwardly into the end piece 50 (by rotating the end piece 50 with a conventional socket driver while the socket 48 is disengaged from the adjusting nut 44), the fingers 38 will be pulled into the sleeve 42, causing the bottom ends of the fingers 38 to push against the inside of the sleeve and close inward about a nut to be removed. This creates a relatively uniform pressure around the nut.

Once the nut is secured within the fingers 38, the socket 48 is pushed down to engage the adjusting nut 44 and the end piece 50 simultaneously. Additional rotational force applied to the end piece 52 (e.g., by the socket driver) will rotate the entire grasping tool 30, now firmly attached to the nut, resulting in the nut being turned.

After the nut has been removed, rotating the end piece 50 in the opposite direction will result in the bolt head 34 and fingers 38 being pushed downward, forcing the grasping portion 58 of the fingers 38 out of the sleeve 42 and apart, thereby releasing the nut.

Figure 6B:
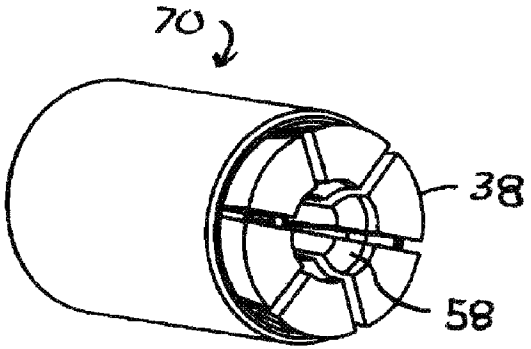
FIG. 6 is a perspective view illustration of a second exemplary embodiment of a grasping tool in accordance with the present invention, showing fingers thereof in an open position.
Figure 7B:
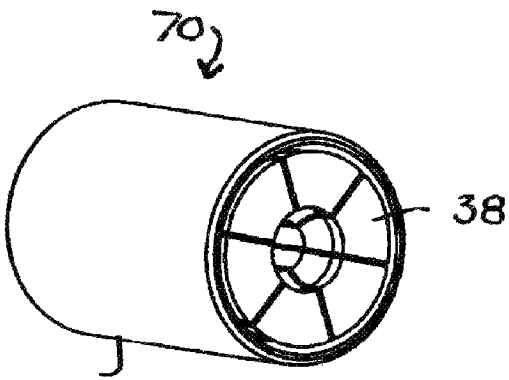
FIG. 7 is a perspective view illustration of the exemplary grasping tool in accordance with the present invention of FIG. 6, showing fingers thereof in a closed position.
Figure 6A:
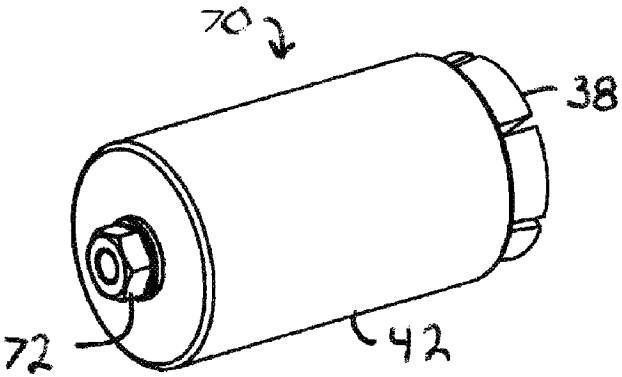
Figure 7A:
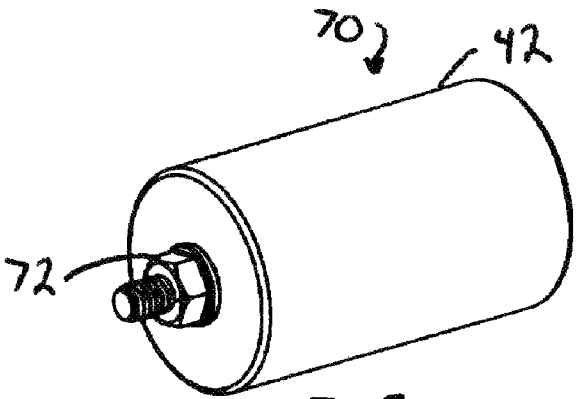
Figure 8:
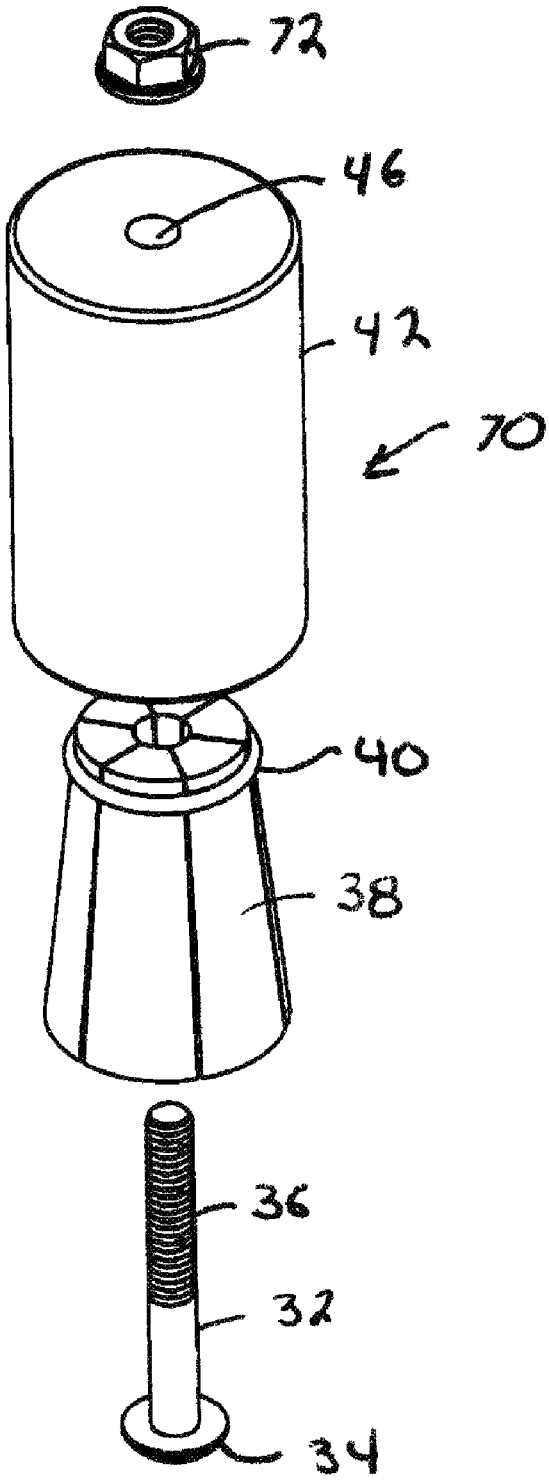
FIG. 8 is an exploded perspective view illustration of the exemplary grasping tool in accordance with the present invention of FIG. 6.
Figure 9:
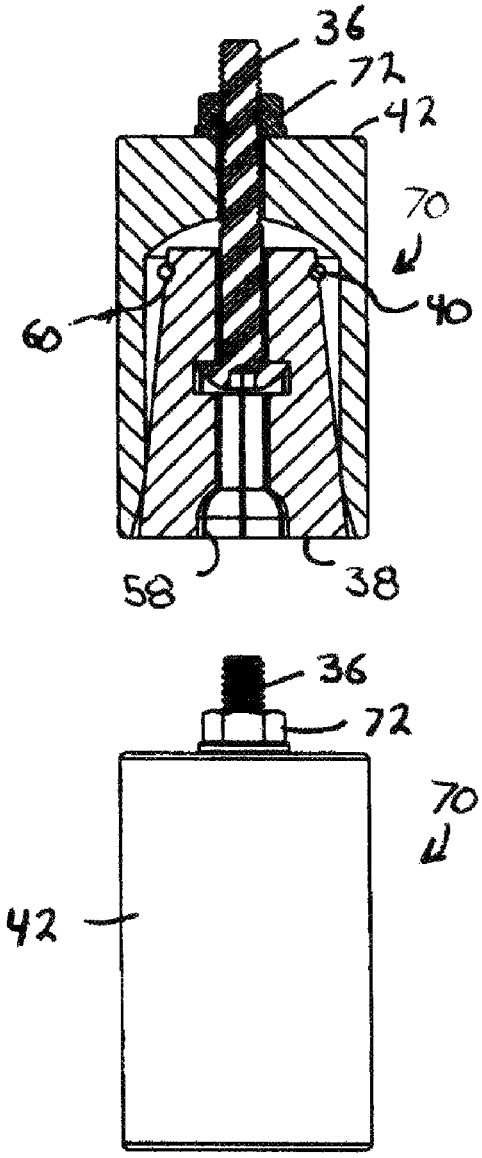
FIG. 9 is a top and bottom cross-section and side view of the exemplary grasping tool in accordance with the present invention of FIG. 6, showing fingers thereof in a closed position.
Figure 10:
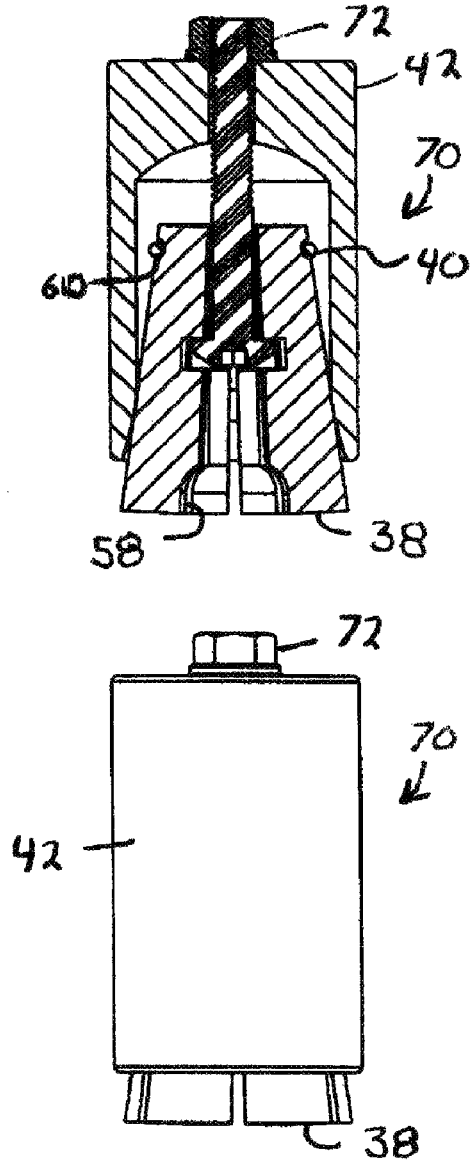
FIG. 10 is a top and bottom cross-section and side view of the exemplary grasping tool in accordance with the present invention of FIG. 6, showing fingers thereof in an open position.
Figure 11:
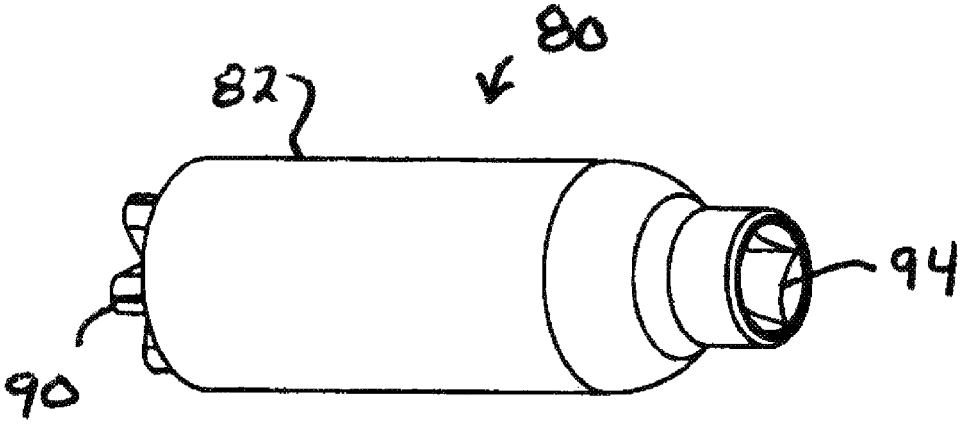
FIG. 11 is a perspective view illustration of a third exemplary embodiment of a grasping tool in accordance with the present invention, showing fingers thereof in a closed position.
Figure 12:
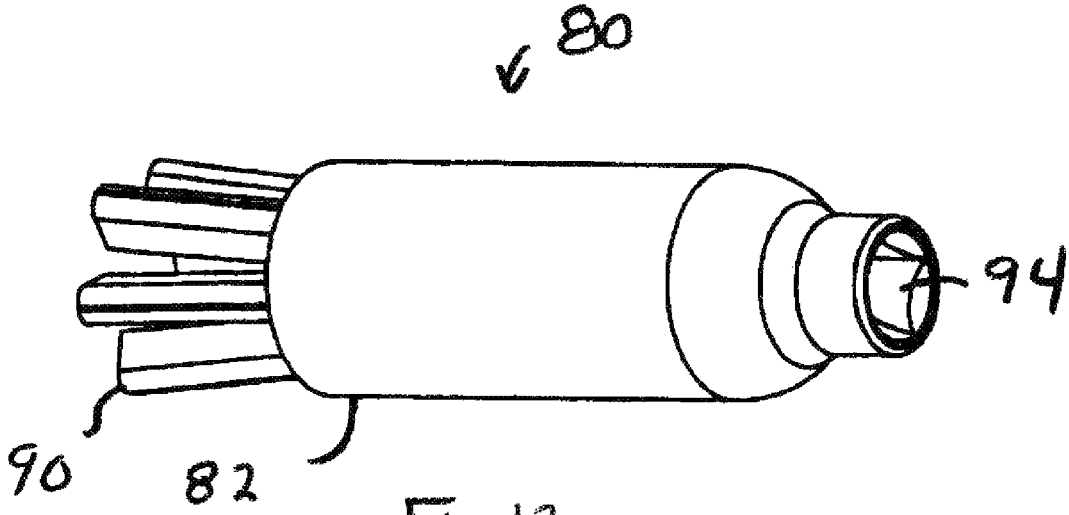
FIG. 12 is a perspective view illustration of the exemplary grasping tool in accordance with the present invention of FIG. 11, showing fingers thereof in an open position.
Figure 13:
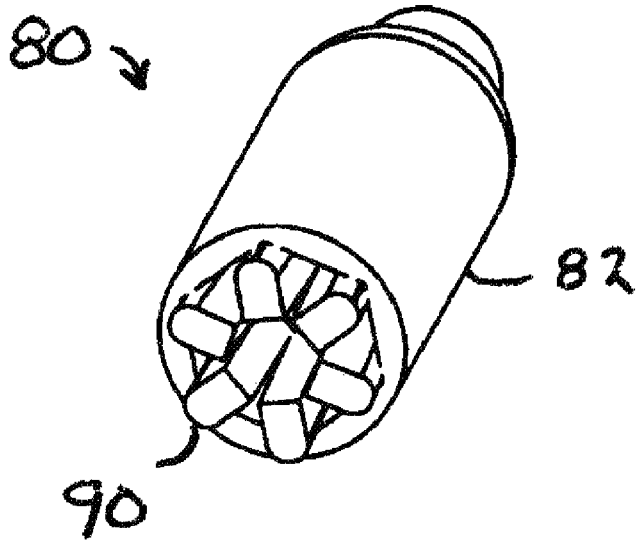
FIG. 13 is a second perspective view illustration of the exemplary grasping tool in accordance with the present invention of FIG. 11, showing fingers thereof in a closed position.
Figure 14:
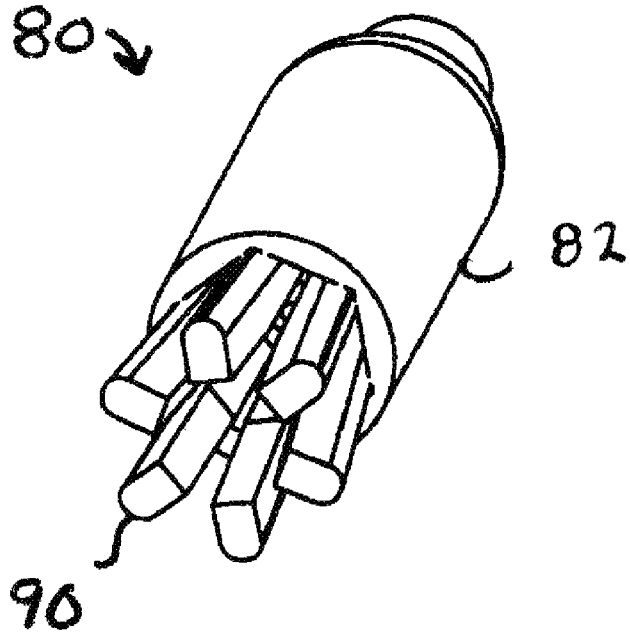
FIG. 14 is a second perspective view illustration of the exemplary grasping tool in accordance with the present invention of FIG. 11, showing fingers thereof in an open position.
Figure 15:
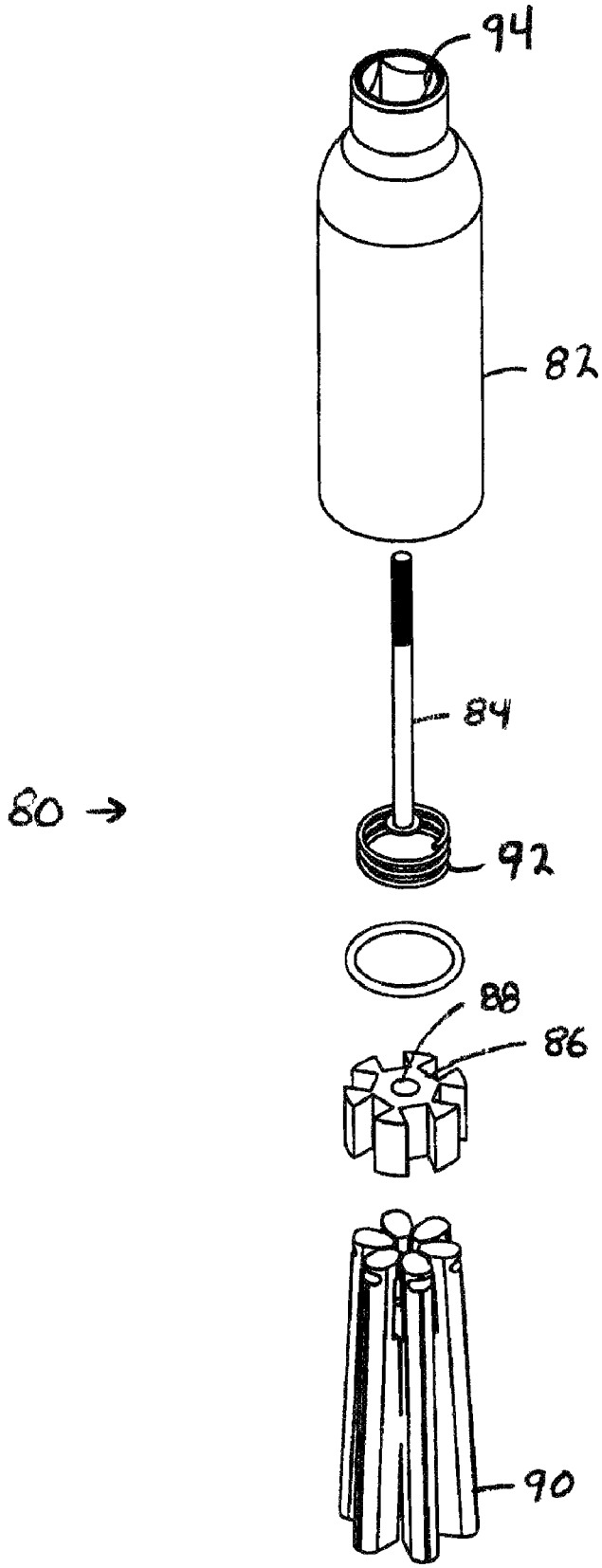
FIG. 15 is an exploded perspective view illustration of the exemplary grasping tool in accordance with the present invention of FIG. 11.
Figure 16:
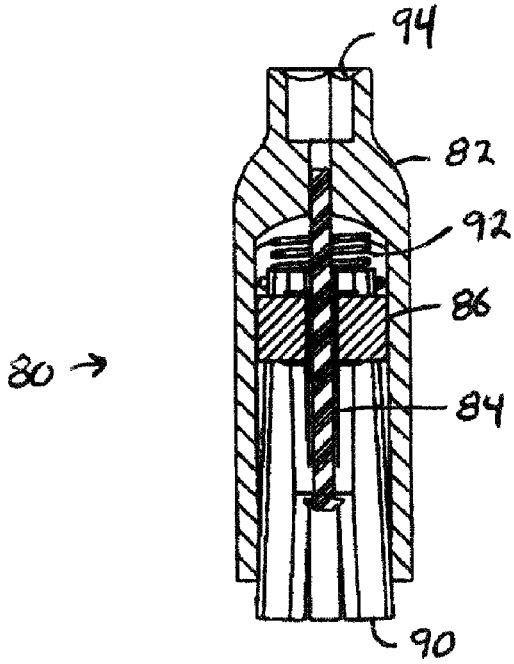
FIG. 16 is a cross-section view of the exemplary grasping tool in accordance with the present invention of FIG. 11, showing fingers thereof in a closed position.
Figure 17:
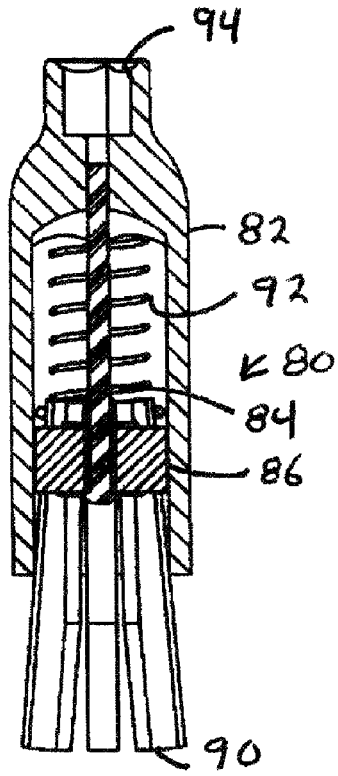
FIG. 17 is a cross-section view of the exemplary grasping tool in accordance with the present invention of FIG. 11, showing fingers thereof in an open position.
Figure 18:
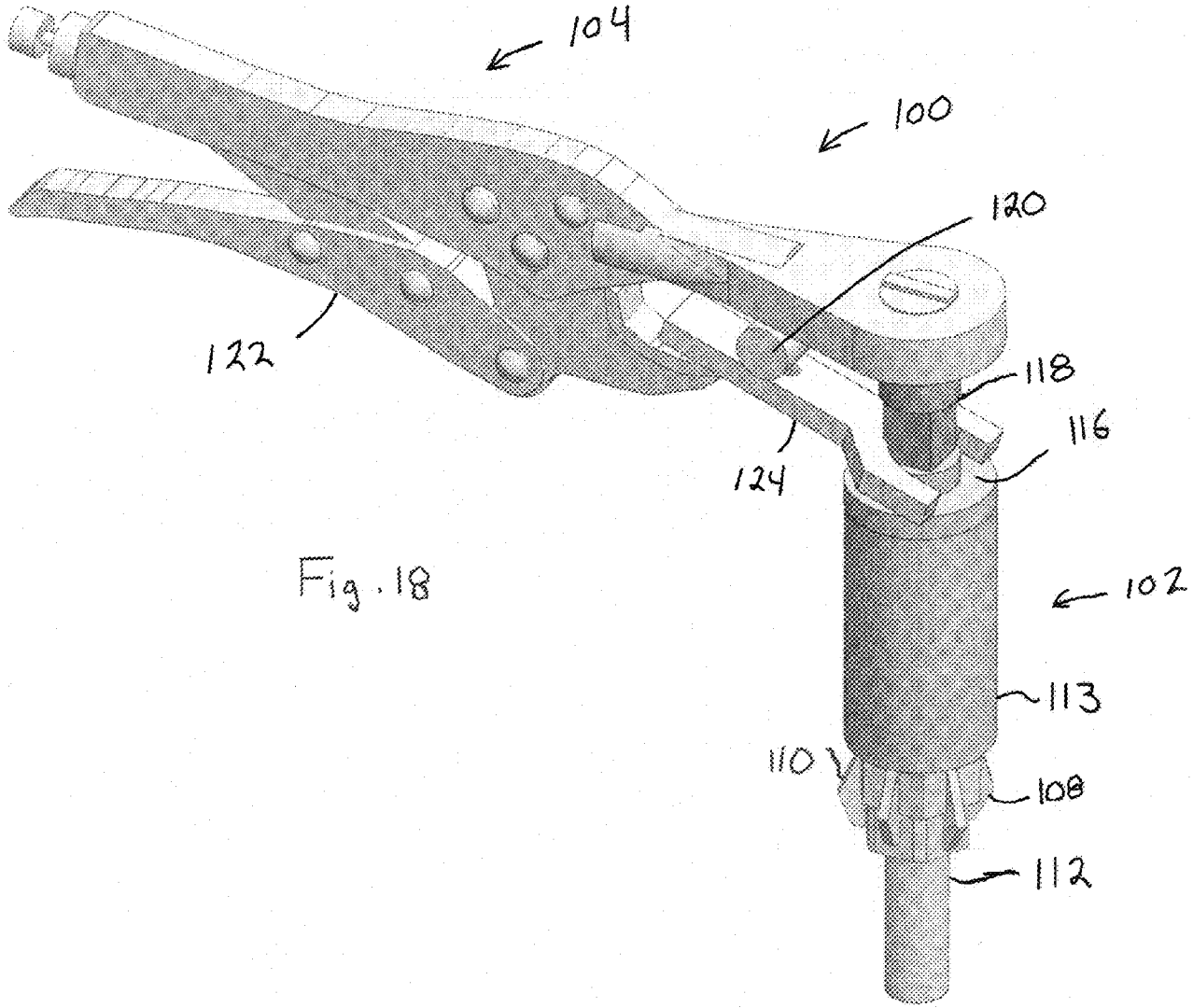
FIG. 18 is a perspective view illustration of another exemplary embodiment of a grasping tool in accordance with the present invention.
Figure 19:
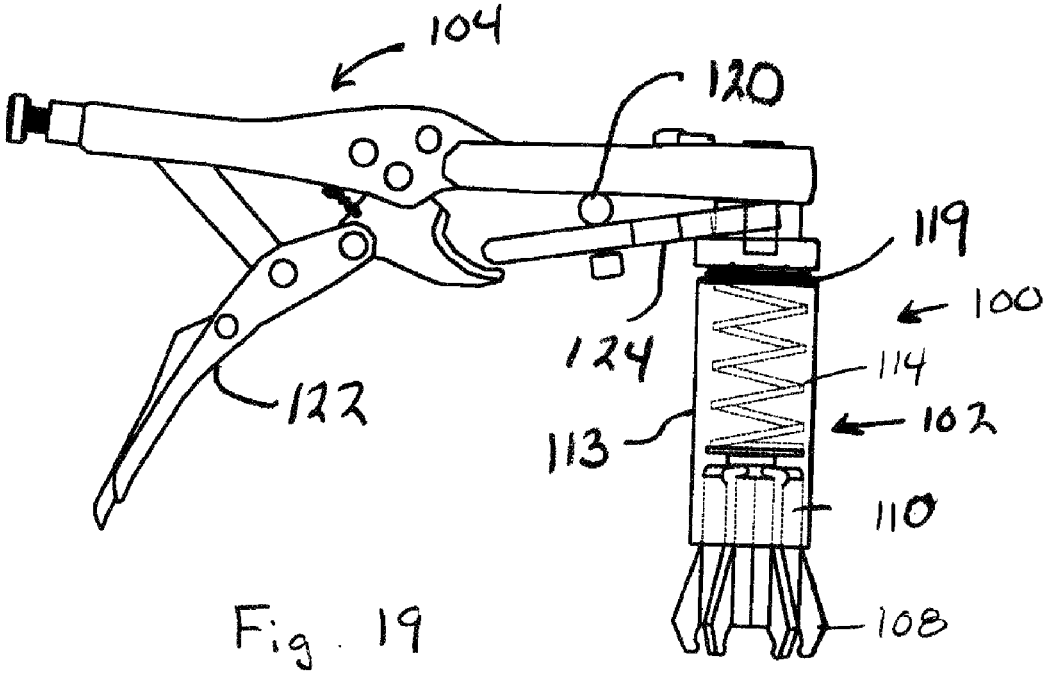
FIG. 19 is a side view illustration in partial cross-section of the exemplary grasping tool in accordance with the present invention of FIG. 18, showing fingers thereof in an open position.
Figure 20:
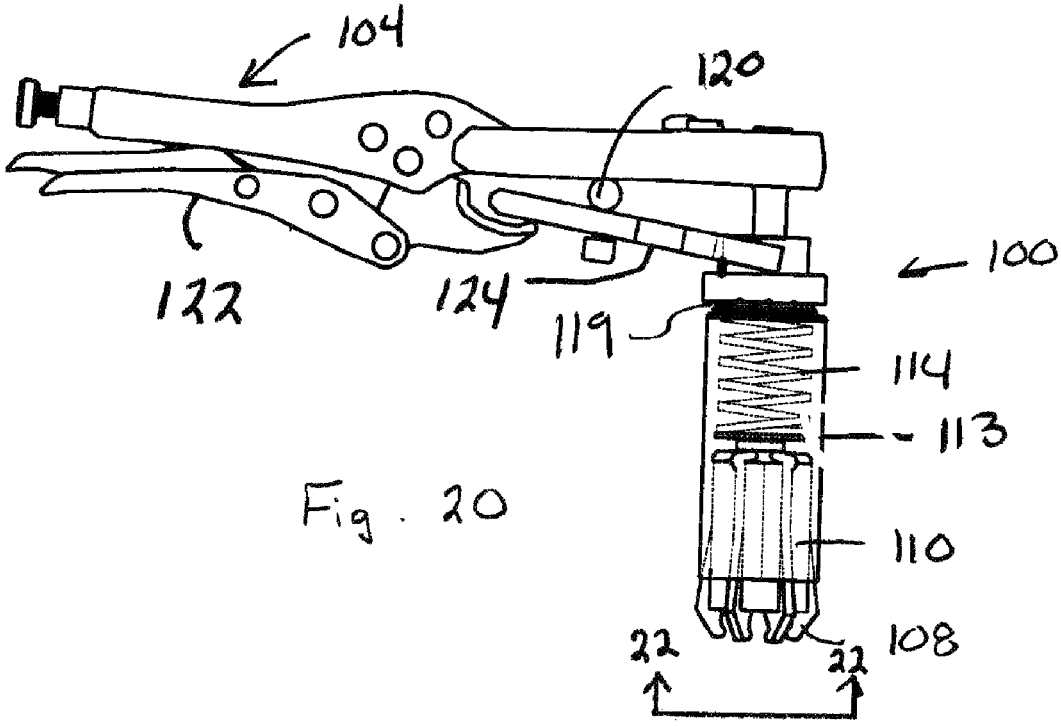
FIG. 20 is a side view illustration in partial cross-section of the exemplary grasping tool in accordance with the present invention of FIG. 18, showing fingers thereof in a closed position.
Figure 21:
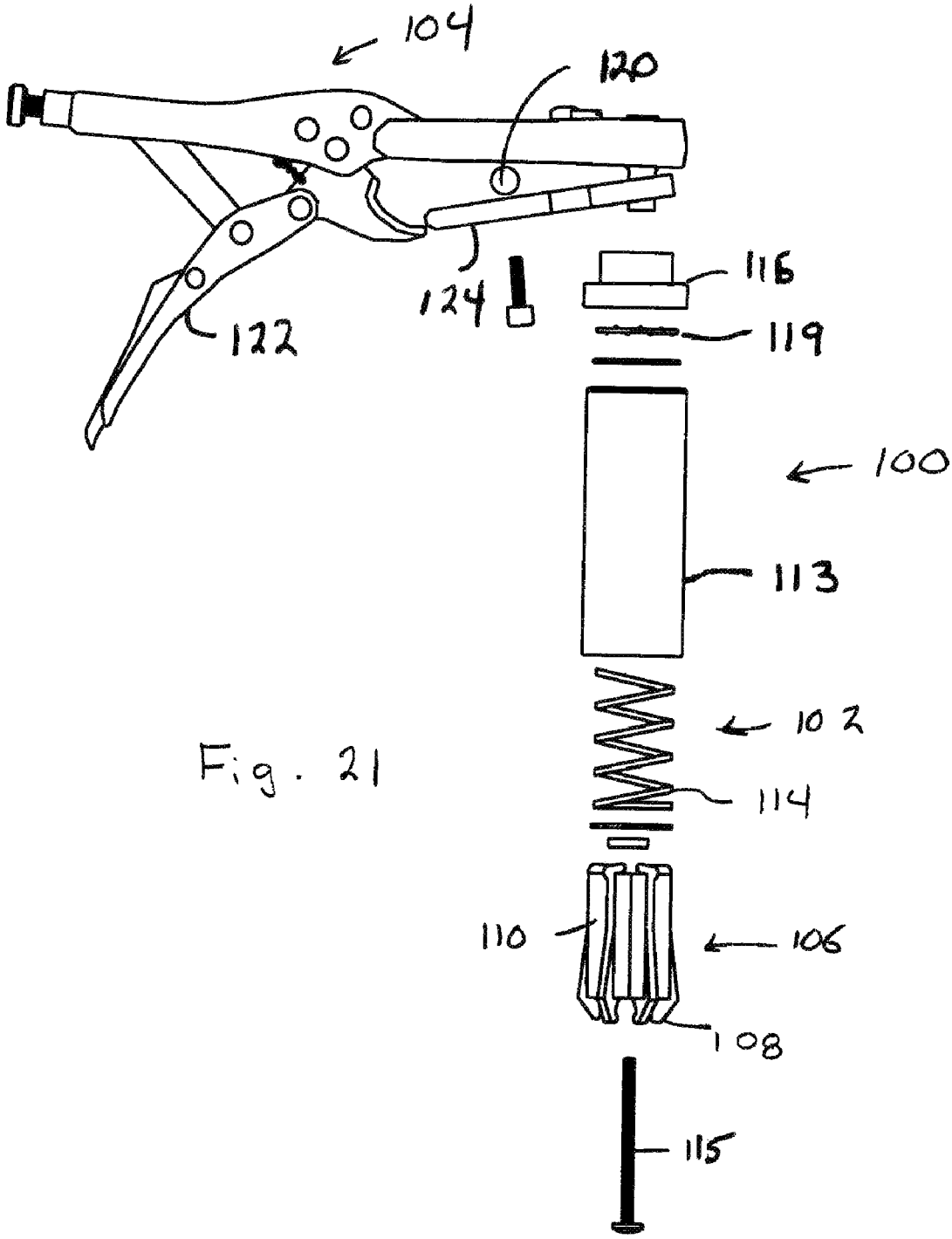
FIG. 21 is a side view exploded view illustration of the exemplary grasping tool in accordance with the present invention of FIG. 18.

Another exemplary embodiment of a grasping tool 70 in accordance with the present invention is depicted in FIGS. 6-10. FIGS. 6 and 10 show this embodiment of the invention in the open position, as it would be to grasp onto a nut or other fastener to be removed. FIGS. 7 and 9 show this embodiment of the invention in the closed position, as it would be when engaging a nut. FIG. 8 shows an exploded view of the device 70 consisting of a bolt 32 that is fed through a series of fingers 38 that extend longitudinally downward. The fingers 38 are bound at the top by a ring 40 that partially sits inside a circular groove 60 formed around the perimeter of the fingers 38. The fingers 38 collectively form a pocket in the inner portion to receive the head of the bolt. The bottom portion of each finger 38 has an indentation 58 on the interior side to accommodate a portion of a nut. The bolt 32 and the fingers 38 are inserted into the sleeve 42, with the threaded end 36 of the bolt 32 exiting through the aperture 46 in the top of the sleeve and being received by an adjusting nut 72.

To remove a nut (or another type of fastening device), the bottom portion of the fingers 38 are placed around the nut and the adjusting nut 72 atop the sleeve 42 is rotated, drawing the threaded bolt 32 upwards through the top portion of the sleeve 42. As the bolt head 34 and engaged fingers 38 are pulled farther inside the sleeve 42, the bottom portion of the fingers 38 move inward, thereby causing the fingers 38 to close in around the nut. Additional rotational force on the adjusting nut 72 will rotate the entire grasping tool 70 that is now secured to the nut, thereby also rotating the nut.

After the nut has been removed from its secured position, the nut is removed from the grasping tool 70 by loosening the adjusting nut 72, thereby allowing the bolt head 34 and finger assembly 38 to slide downward from the sleeve 42. As the fingers 38 exit the sleeve 42, the bottom portion of the fingers 38 move apart, and the loosened nut may be removed from the grasping tool 70.

A further embodiment of a grasping tool 80 in accordance with the present invention, using a different method of opening and closing the fingers, is illustrated in FIGS. 11-17. In this embodiment of the present invention, the grasping tool 80 the includes a sleeve 82 with a partially threaded bolt 84 affixed to and extending downward from the inside top portion thereof, and a cog shaped structure 86 with an aperture 88 in the center, where the cog structure 86 slides upon the shaft of the bolt 84. Fingers 90 engage and substantially surround the cog 86, such that as the fingers 90 move upwards inside the sleeve 82 the cog 86 guides them and keeps them uniform. A spring 92 may be located inside the sleeve 82 between the cog 86 and the top of the inside portion of the sleeve 42. The spring 92 acts to push the cog 86 and fingers 90 downward outside the sleeve 82, thereby pushing the fingers 90 apart to receive a fastening device such as a nut. To engage a nut, the fingers are 90 are placed about the nut and the sleeve 82 is pushed downward, this causes the fingers 90, guided by the cog 86, to move at least substantially inside the sleeve 42 resulting in pressure around the nut. An indentation 94 is located at the top of the sleeve 82 to accommodate a socket driver. When a socket drive is inserted and rotated, the sleeve 82 and the fingers 90 are rotated along with the nut.

A further exemplary embodiment 100 of the present invention, having additional desirable features, will now be described with reference to FIGS. 18-22. In this embodiment 100 of the invention a sleeve containing the fingers is operated by lever action to bring the ends of the fingers into tight contact with a nut or other fastener to be removed. This embodiment of the present invention may thus include a fastener grasping portion 102 and a lever actuation portion 104.

The grasping portion 102 of this embodiment 100 of the present invention features a finger assembly 106. The finger assembly 106 includes fingers 108 for grasping a nut, as described previously, as well as a finger support structure 110. As illustrated best in FIG. 22, the finger support structure 110 includes a series of evenly spaced elongated longitudinal grooves 111 formed radially thereon. One elongated groove 111 is provided in the finger support structure 106 for each finger 108. Each elongated groove 111 is formed only slightly larger in width than the width of each finger 108.

Figure 22:
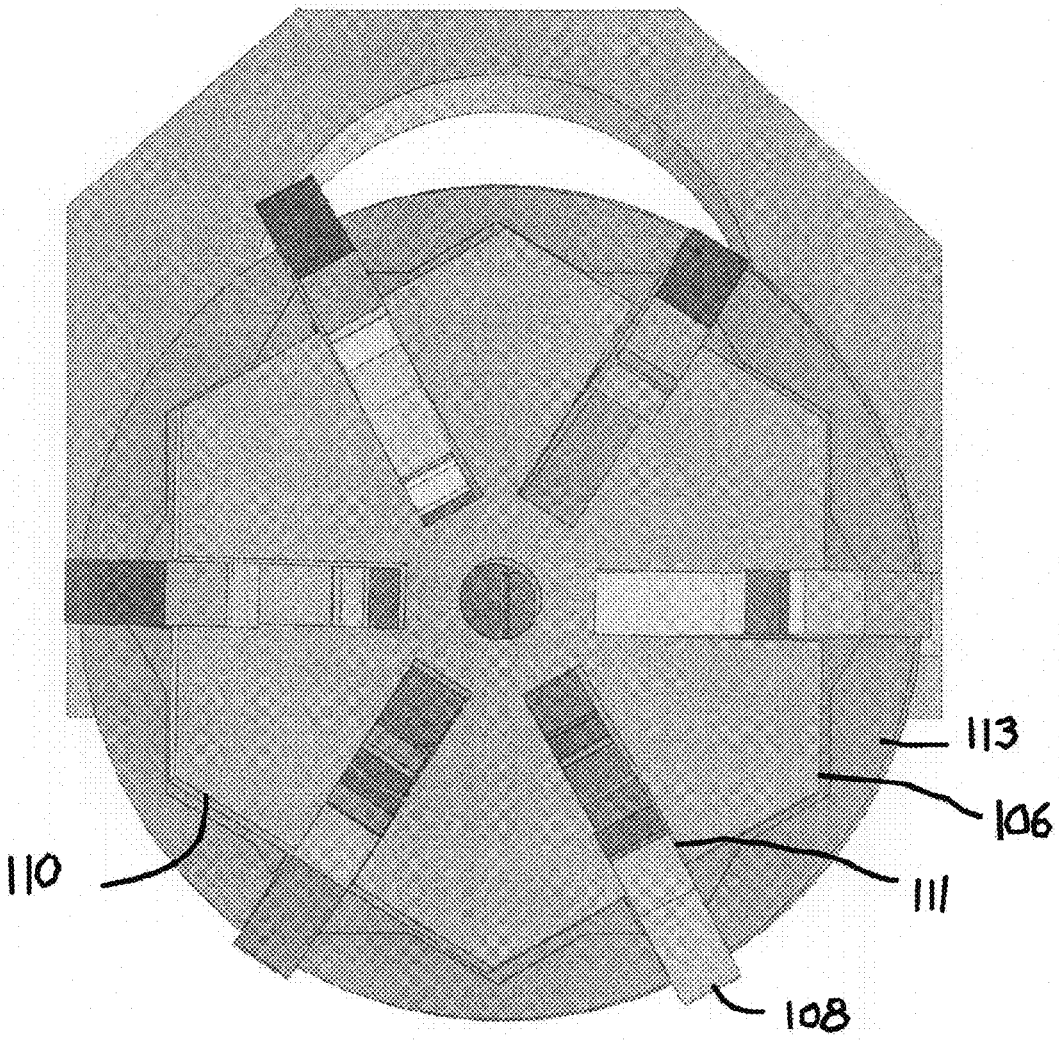
FIG. 22 is a view of the exemplary grasping tool in accordance with the present invention of FIG. 18 as taken along the line 22-22 of FIG. 20, showing in more detail a finger assembly in a sleeve thereof.

The fingers 108 are positioned with respect to the support structure 110 so as to reside in the grooves 111, with one finger 108 in each groove. The length of the fingers 108 is such that the ends of the fingers 108 that are to grasp a nut, bolt, or other fastener 112 (see FIG. 18) extend beyond a lower end of the finger support structure 110. The entire finger assembly 106 is then mounted in a sleeve 113. As shown in FIG. 22, the interior wall of the sleeve 113 may take the form of a conventional twelve point socket. In this configuration, the finger support structure 110 may have a hexagonal cross section, with the points of the support structure 110 fitting in alternating grooves in the interior wall of the sleeve 113. The elongated grooves 111 in the support structure 110 are formed midway between the points thereof, such that the fingers 108 mounted therein are disposed in the other alternating grooves in the interior wall of the sleeve 113. As can be seen, the finger support structure 106 provides radial support for the fingers 108, thereby preventing radial movement of the fingers 108 when the fingers 108 are grasping and turning a nut or other fastener 112 structure being removed.

The finger assembly 106 is mounted in the sleeve 113 in the manner described previously. A compression spring 114 may be provided, as described above, between the assembly 106 and the top of the sleeve 113, to push the assembly 106 downward to facilitate removal of a nut from the grasp of the fingers 108.

A threaded bolt 115 extends upward through the finger assembly 106 and through a hole in the top of the sleeve 111 and through a lever plate 116 attached at the top of the sleeve. The threaded end of the bolt 115 is attached to a cap piece 118 mounted at the top of the lever plate 116. The cap piece 118 may have a conventional socket structure formed in the top thereof to facilitate the mounting of the lever portion 104 to the grasping portion 102. Note that appropriate bearing structures 119 may be positioned at the top of the sleeve 113 in the grasping portion 102 to facilitate ratchet action when the grasping portion is rotated via the lever portion 104 to remove a nut, bolt, or other fastener 112 to which it is attached.

The lever portion 104 includes a pivot structure 120. Operation of a locking plier like structure 122 about the pivot structure 120 operates a lever 124, the end of which is adjacent to the lever plate 116, to push the sleeve 113 forward toward the ends of the fingers 108, thereby bringing the ends of the fingers 108 together to grasp firmly a bolt 112 or other structure to be removed. The locking structure locks the fingers 108 in this grasping position. The lever structure 104 may then be rotated to remove the nut, bolt, or other structure 112.

It is contemplated that the aforementioned components may be sized to accommodate varying size nuts and other types of fasteners. A very large size for industrial applications is contemplated along with a very small and portable device for light duty applications. The grasping portion of the fingers may be configured to match the common indentations of a nut or they may be round or another shape configured to handle any particular type of securing device, such as a square nut, cap-nut or an elliptical fastener. Additionally, the fingers may have various cross-sectional shapes such as elliptical, round, or trapezoidal.

The end piece, which has been described and shown to receive a socket driver may also be configured to receive various other tools such as a screwdriver or other device configured to provide rotational force. The components described in the aforementioned invention would preferably be made of hardened steel, but may also be made of other suitable materials depending on the application and the particular needs; for example, for use in wet environments, the device may be made of aluminum or galvanized steel or have a corrosion resistant finish. Further, the spring used in the various embodiments may be of varying lengths and resilience, and may be used in any one of the embodiments.

It is noted that a grasping tool in accordance with the present invention is capable of grasping nuts and other fasteners over a continuous, but limited, range of sizes. Thus, a single grasping tool in accordance with the present invention may serve as universal socket for a range of fastener sizes. A few grasping tools in accordance with the present invention, each covering a different range of fastener sizes, may thus be used to replace two entire sets (one standard and one metric) of conventional socket wrench sockets.

It is understood that the invention is not confined to the particular construction and arrangement of parts herein illustrated and described, but embraces such modified forms thereof as come within the scope of the following claims.

What is claimed is:

1. A grasping tool comprising:

a. a sleeve having a closed first end and an open second end;

b. a plurality of fingers arranged radially within the sleeve and mounted within the sleeve for longitudinal movement therein, and such that ends of the fingers extend from the open end of the sleeve;

c. means for moving the sleeve over the fingers toward the ends thereof such that the ends of the fingers are moved radially inward thereby to grasp a fastener positioned between the ends of the fingers;

d. a finger support structure having longitudinal grooves formed therein, the finger support structure being mounted in the sleeve for longitudinal movement therein along with the fingers, wherein the fingers are positioned in the longitudinal grooves of the support structure; and e. a spring mounted in the sleeve between the fingers and the closed first end of the sleeve so as to bias the fingers in the direction of the open second end of the sleeve.

2. The grasping tool of claim 1 further comprising a connecting structure having:

a. a first end attached to ends of the fingers located within the sleeve, and b. an opposing threaded second end attached to a structure effecting relative movement of the sleeve and fingers with respect to each other, the connecting structure extending into an aperture formed in the closed first end of the sleeve.

3. The grasping tool of claim 2 wherein the second end of the connecting structure is threaded into a cap piece such that the cap piece may be rotated to move the sleeve with respect to the fingers.

4. The grasping tool of claim 2 wherein the second end of the connecting structure is attached to a lever structure for moving the sleeve with respect to the fingers.

5. The grasping tool of claim 1, wherein:

a. the connecting structure is threaded, and b. rotation of the connecting structure moves the finger support structure and fingers within the sleeve interior in a lengthwise direction along the sleeve.

6. A grasping tool comprising:

a. a sleeve having a length extending between a closed first end and an open second end, the open second end opening onto a sleeve interior bounded by sleeve interior walls;

b. an elongated connecting structure extending into the closed first end of the sleeve;

c. several fingers:

(1) arrayed to rest:

i. in a circumferential direction about a lengthwise axis extending from the connecting structure, and ii. closely adjacent the sleeve interior walls, (2) being separately formed such that each finger can be removed from the other fingers, and (3) each bearing an indentation, wherein the fingers are pivotally linked together to pivot about their indentations; and d. a finger support structure having:

(1) an outer circumference closely fit adjacent the sleeve interior walls, and (2) a central aperture spaced inwardly from the outer circumference, wherein:

(i) motion of the connecting structure within the sleeve results in lengthwise motion of the fingers within the sleeve interior, with the fingers moving radially inwardly as they move toward the closed first end of the sleeve and radially outwardly as they move toward the open second end of the sleeve, (ii) the finger support structure is translatable along the length of the sleeve within the sleeve interior, and (iii) the fingers are linked in pivotal relation to the finger support structure.

7. The grasping tool of claim 6 further including an annular member fit within the indentations, the annular member pivotally linking the fingers together.

8. The grasping tool of claim 6 wherein the outer circumference of the finger support structure bears grooves wherein the fingers are fit.

9. The grasping tool of claim 6 further including an annular member fit within the indentations, the annular member pivotally linking the fingers to the finger support structure.

10. The grasping tool of claim 6 further including a spring situated in the sleeve interior between the closed first end and the finger support structure.

11. The grasping tool of claim 10, wherein the spring biases the fingers in the direction of the open second end of the sleeve.

12. The grasping tool of claim 6 wherein the connecting structure extends into both:

a. the central aperture of the finger support structure, and b. the closed first end of the sleeve.

13. The grasping tool of claim 6 wherein:

a. the outer circumference of the finger support structure bears grooves wherein the fingers are fit, b. the connecting structure extends into both:

(1) the central aperture of the finger support structure, and (2) the closed first end of the sleeve.

14. The grasping tool of claim 6, wherein:

a. the connecting structure is threaded, and b. rotation of the connecting structure moves the finger support structure and fingers within the sleeve interior in a lengthwise direction along the sleeve.

15. A grasping tool comprising:

a. a sleeve having a length extending between a closed first end and an open second end, the open second end opening onto a sleeve interior bounded by sleeve interior walls;

b. an elongated connecting structure extending into the closed first end of the sleeve;

c. several fingers:

(1) arrayed to rest:

i. in a circumferential direction about a lengthwise axis extending from the connecting structure, and ii. closely adjacent the sleeve interior walls, (2) being separately formed such that each finger can be removed from the other fingers, and (3) each bearing an indentation, wherein the fingers are pivotally linked together to pivot about their indentations;

d. a driving piece:

(1) adjacent the closed first end of the sleeve outside the sleeve interior, (2) threadably engaged to the connecting structure, and e. a socket:

(1) having an interior circumference configured to complementarily engage both:

i. an outer circumference of the driving piece, and ii. the closed first end of the sleeve, wherein torque imparted to the socket is transmitted to one or more of the outer circumference of the driving piece and the closed first end of the sleeve, (2) the socket being translatably situated on the outer circumference of the driving piece to translate into complementarily engage the closed first end of the sleeve;

wherein motion of the connecting structure within the sleeve results in lengthwise motion of the fingers within the sleeve interior, with the fingers moving radially inwardly as they move toward the closed first end of the sleeve and radially outwardly as they move toward the open second end of the sleeve.

16. The grasping tool of claim 15 wherein the connecting structure has a threaded portion extending into the closed first end, the threaded portion being joined to the driving piece.

17. A grasping tool comprising:

a. a sleeve having a length extending between a closed first end and an open second end, the open second end opening onto a sleeve interior bounded by sleeve interior walls;

b. a finger support structure having:

(1) an outer circumference closely fit adjacent the sleeve interior walls, (2) a central aperture spaced inwardly from the outer circumference, wherein the finger support structure is translatable along the length of the sleeve within the sleeve interior;

c. a connecting structure extending into the central aperture of the finger support structure and into the closed first end of the sleeve;

d. several fingers:

(1) arrayed in a circumferential direction about the finger support structure to rest closely adjacent the sleeve interior walls, (2) being linked in pivotal relation to the finger support structure, and (3) being separately formed such that each can be separately removed from the finger support structure;

wherein:

(i) motion of the connecting structure in a lengthwise direction along the sleeve results in lengthwise motion of the finger support structure and fingers within the sleeve interior, with the fingers moving radially inwardly as the finger support structure moves toward the closed first end of the sleeve, (ii) the connecting structure is threaded, and (iii) rotation of the connecting structure moves the finger support structure and fingers within the sleeve interior in a lengthwise direction along the sleeve.

18. The grasping tool of claim 17 further including a spring situated in the sleeve interior between the closed first end and the finger support structure.

19. The grasping tool of claim 18, wherein the spring biases the fingers in the direction of the open second end of the sleeve.

20. A grasping tool comprising:

a. a sleeve having a length extending between a closed first end and an open second end, the open second end opening onto a sleeve interior bounded by sleeve interior walls;

b. a finger support structure having:

(1) an outer circumference closely fit adjacent the sleeve interior walls, (2) a central aperture spaced inwardly from the outer circumference, wherein the finger support structure is translatable along the length of the sleeve within the sleeve interior;

c. a connecting structure extending into the central aperture of the finger support structure and into the closed first end of the sleeve, the connecting structure being threaded;

d. several fingers:

(1) arrayed in a circumferential direction about the finger support structure to rest closely adjacent the sleeve interior walls, (2) being linked in pivotal relation to the finger support structure, and (3) being separately formed such that each can be separately removed from the finger support structure;

wherein:

(i) rotational motion of the connecting structure in a lengthwise direction along the sleeve results in lengthwise motion of the finger support structure and fingers within the sleeve interior, with the fingers moving radially inwardly as the finger support structure moves toward the closed first end of the sleeve, and (ii) the outer circumference of the finger support structure bears grooves wherein the fingers are fit.

21. A grasping tool comprising:

a. a sleeve having a length extending between a closed first end and an open second end, the open second end opening onto a sleeve interior bounded by sleeve interior walls;

b. a finger support structure having:

(1) an outer circumference closely fit adjacent the sleeve interior walls, (2) a central aperture spaced inwardly from the outer circumference, wherein the finger support structure is translatable along the length of the sleeve within the sleeve interior;

c. a connecting structure extending into the central aperture of the finger support structure and into the closed first end of the sleeve;

d. several fingers:

(1) arrayed in a circumferential direction about the finger support structure to rest closely adjacent the sleeve interior walls, (2) being linked in pivotal relation to the finger support structure, and (3) being separately formed such that each can be separately removed from the finger support structure;

wherein:

(i) motion of the connecting structure in a lengthwise direction along the sleeve results in lengthwise motion of the finger support structure and fingers within the sleeve interior, with the fingers moving radially inwardly as the finger support structure moves toward the closed first end of the sleeve, and (ii) the fingers bear indentations about which the fingers pivot.

22. The grasping tool of claim 21 further including an annular member fit within the indentations, the annular member pivotally linking the fingers to the finger support structure.

23. The grasping tool of claim 21, wherein:

a. the connecting structure is threaded, and b. rotation of the connecting structure moves the finger support structure and fingers within the sleeve interior in a lengthwise direction along the sleeve.

* * * * *